US008640416B2

(12) United States Patent
Cullen

(10) Patent No.: US 8,640,416 B2
(45) Date of Patent: Feb. 4, 2014

(54) SLIDING AND LOCKING ENERGY-EFFICIENT WALL ASSEMBLY

(76) Inventor: Bernard Ted Cullen, Winnipeg (CA)

( * ) Notice: Subject to any disclaimer, the term of this patent is extended or adjusted under 35 U.S.C. 154(b) by 0 days.

(21) Appl. No.: 13/277,073

(22) Filed: Oct. 19, 2011

(65) Prior Publication Data

US 2012/0151859 A1 Jun. 21, 2012

Related U.S. Application Data

(60) Provisional application No. 61/394,709, filed on Oct. 19, 2010.

(51) Int. Cl.
*E04C 1/41* (2006.01)
*E04B 2/46* (2006.01)

(52) U.S. Cl.
USPC ..... 52/481.1; 52/779; 52/508; 52/309.9

(58) Field of Classification Search
USPC ..... 52/309.4, 309.8, 309.9, 309.11, 762, 52/479, 480, 481.1, 483.1, 772, 777, 778, 52/779, 235, 169.11, 506.05, 508, 511
See application file for complete search history.

(56) References Cited

U.S. PATENT DOCUMENTS

| | | | | |
|---|---|---|---|---|
| 1,872,522 | A | 8/1932 | Stuckey | |
| 2,514,571 | A | 7/1950 | Fry | |
| 3,122,860 | A * | 3/1964 | Schulze | 52/309.11 |
| 3,182,423 | A * | 5/1965 | Jennings | 52/99 |
| 3,435,581 | A * | 4/1969 | Ahlqvist | 52/405.1 |
| 3,611,653 | A | 10/1971 | Zinn | |
| 3,881,292 | A * | 5/1975 | Porter | 52/461 |
| 3,990,204 | A | 11/1976 | Haworth et al. | |
| 4,191,001 | A * | 3/1980 | L'Heureux | 52/742.13 |
| 4,333,290 | A * | 6/1982 | Koberstein | 52/376 |
| 5,024,033 | A | 6/1991 | Anderson | |
| 5,230,941 | A | 7/1993 | Hollander et al. | |
| 5,373,678 | A | 12/1994 | Hesser | |
| 5,628,158 | A * | 5/1997 | Porter | 52/309.9 |
| 5,634,305 | A * | 6/1997 | Erlanger | 52/235 |
| 5,655,343 | A | 8/1997 | Seals | |
| 5,673,529 | A * | 10/1997 | Treister et al. | 52/511 |
| 5,815,992 | A | 10/1998 | Spencer et al. | |
| 5,833,796 | A | 11/1998 | Matich | |
| 6,280,669 | B2 * | 8/2001 | Kistner et al. | 264/135 |
| 6,325,223 | B1 | 12/2001 | Hannen | |

(Continued)

FOREIGN PATENT DOCUMENTS

| | | | |
|---|---|---|---|
| EP | 0691441 | A1 | 1/1996 |
| WO | WO/03/027406 | A2 | 4/2003 |
| WO | WO/2006/019318 | A1 | 2/2006 |

*Primary Examiner* — Brent W Herring
(74) *Attorney, Agent, or Firm* — IProperty Inc.

(57) ABSTRACT

A sliding and locking energy-efficient wall assembly includes a plurality of: parallel spaced apart foam posts, foam panels, framing/spacing members, and finishing wall panels. The foam posts are vertically disposed on a foundation wall, and have ends dimensioned to contact and adhere to the surface of the wall, an inside end opposite the planar end, and two opposing side flanged ends. Grooves on the foam panels are dimensioned to receive the side flanged ends of the foam posts. The framing/spacing members have a web and flange portions, to engage the inside grooved ends of the foam posts to provide an interior attachment surface for the finishing wall panels. The finishing wall panels are secured to the web portions of the framing/spacing members, whereby an air space is created between the foam panels and the finishing wall panels. The framing/spacing members and foam posts are adjustable to permit plumb installation.

2 Claims, 7 Drawing Sheets

(56) References Cited

U.S. PATENT DOCUMENTS

| | | | | |
|---|---|---|---|---|
| 6,886,783 | B2 * | 5/2005 | Guard et al. | 244/119 |
| 6,976,337 | B2 | 12/2005 | Hiraki | |
| 7,743,575 | B2 * | 6/2010 | Ito | 52/582.1 |
| 8,272,182 | B1 * | 9/2012 | Spiegel | 52/407.1 |
| 2002/0088184 | A1 | 7/2002 | Hiraki | |
| 2003/0056456 | A1 | 3/2003 | Heydon | |
| 2003/0192276 | A1 | 10/2003 | Heydon | |
| 2004/0062919 | A1 | 4/2004 | Kuchenmeister et al. | |
| 2005/0019511 | A1 | 1/2005 | Piemonte et al. | |
| 2005/0120648 | A1 | 6/2005 | Gorman | |
| 2006/0265988 | A1 * | 11/2006 | Fujito et al. | 52/511 |
| 2006/0283536 | A1 | 12/2006 | Campisi et al. | |
| 2007/0101678 | A1 | 5/2007 | Miniter | |
| 2008/0005988 | A1 | 1/2008 | Dombowsky | |
| 2009/0165411 | A1 | 7/2009 | Schiffmann et al. | |
| 2009/0249726 | A1 | 10/2009 | Garcia Fernandez | |
| 2010/0005746 | A1 * | 1/2010 | Lemay | 52/506.05 |
| 2010/0325999 | A1 * | 12/2010 | Devalapura | 52/506.05 |

* cited by examiner

SLIDING AND LOCKING ENERGY-EFFICIENT WALL ASSEMBLY

RELATED APPLICATIONS

This application claims priority of the earlier filed U.S. Provisional Application Ser. No. 61/394,709 filed Oct. 19, 2010, the contents of which are hereby incorporated by reference in their entirety.

TECHNICAL FIELD

The present invention relates generally to a building wall assembly. More particularly, the present invention relates to an energy-efficient building wall assembly that may inhibit or reduce heat loss via conduction, convection and radiation.

BACKGROUND OF THE INVENTION

In building construction there has long existed the problem of undesirable heat transfer as exemplified by the heat loss through typical wall structures, which are typically comprised of materials of poor thermal resistance, such as poured concrete for example.

Various attempts have been made to enhance the insulation value of these conventional wall structures. One such conventional attempt is the fiberglass insulation technique, which involves securing a number of spaced-apart vertical 2'×4' studs on the wall structure (e.g. concrete wall) to create a wall framing, followed by installing rigid insulation material such as fiber glass between these studs, and completed by securing drywall panels to the planar surfaces of the studs to create a final wall surface. Drawbacks of this fiberglass insulation technique lie in its ineffectiveness in resisting heat transfer through convection and radiation, the time and effort required to install it, and the difficulty in achieving plumb or vertical interior walls.

SUMMARY OF THE INVENTION

Certain features, aspects and examples disclosed herein are directed to a sliding and locking energy-efficient wall assembly which may be advantageously adapted for a wide variety of applications where enhanced structural insulation capacity, and/or faster time and reduced costs for insulation installation are desired, including applications in various types of buildings, such as concrete, steel, post frame, animal confinement, and quonset and tarp buildings, for example. Additional features, aspects and examples are discussed in more detail herein.

In accordance with a first aspect, a sliding and locking energy-efficient wall assembly is disclosed. In one embodiment, the sliding and locking energy-efficient wall assembly includes a plurality of parallel spaced apart foam posts vertically disposed on a foundation wall. The foam posts each have a horizontal cross section of a predetermined shape defined by at least four major ends including an outside planar end dimensioned to contact and adhere to the surface of the foundation wall, an inside grooved end opposite the planar end, and two opposing side flanged ends.

In one embodiment, the sliding and locking energy-efficient wall assembly further includes a plurality of foam panels having a first major surface, a second major surface opposing the first major surface, and two lateral ends each having a groove defined therein. The grooves defined in the lateral ends of the foam panels are dimensioned to receive the side flanged ends of the foam posts in a mating relationship such that each of the respective foam panels is disposed between two respective sequential foam posts and such that the first major surfaces of the foam panels are in contact with the surface of the foundation wall. Each of the foam panels has a thickness less than the transverse depth of the foam posts such that when the non-coated major surfaces of the foam panels and the outside horizontal planer ends of the foam posts are secured to the foundation wall, the inside grooved ends of the foam posts extend past the reflective-layer-coated major surfaces of the foam panels.

In one embodiment, the sliding and locking energy-efficient wall assembly further includes a plurality of framing/spacing members each corresponding to different one of the foam posts. The framing/spacing members each have a web portion and a flange portion. The flange portions of the framing/spacing members are dimensioned to engage the inside grooved ends of the foam posts in a mating relationship such that the web portions provide an interior attachment surface for a plurality of finishing wall panels.

In one embodiment, the finishing wall panels each include an interior surface and an exterior surface. The exterior surfaces of the finishing wall panels are in contact with and secured to the web portions of the framing/spacing members, whereby an air space is created between the reflective-layer-coated major surfaces of the foam panels and the exterior surfaces of the finishing wall panels.

Preferably, the mating relationships between the framing/spacing members and the foam posts are adjustable to permit plumb installation of the finishing wall panels.

Further advantages of the invention will become apparent when considering the drawings in conjunction with the detailed description.

BRIEF DESCRIPTION OF THE DRAWINGS

The sliding and locking energy-efficient wall assembly of the present invention will now be described with reference to the accompanying drawing figures, in which.

Like reference numerals refer to corresponding parts throughout the several views of the drawings.

DETAILED DESCRIPTION OF THE INVENTION

Certain embodiments of the invention provide for a modular sliding and locking energy-efficient wall assembly that advantageously achieves the functions of traditional building energy conservation components, including vapor barriers, air barriers, radiant barriers, insulators and building wraps, into one integrated structure that advantageously inhibits or reduces heat loss through building walls and structures (e.g. foundation walls) via conduction, convection and radiation, and may further advantageously provide for the plumb installation of the sliding and locking energy-efficient wall assembly over building foundation walls or structures without the need of conventional furring shims. This invention is fast and inexpensive to install due to its modular nature and ease of adaptation due to advantageous materials.

Figure 1:
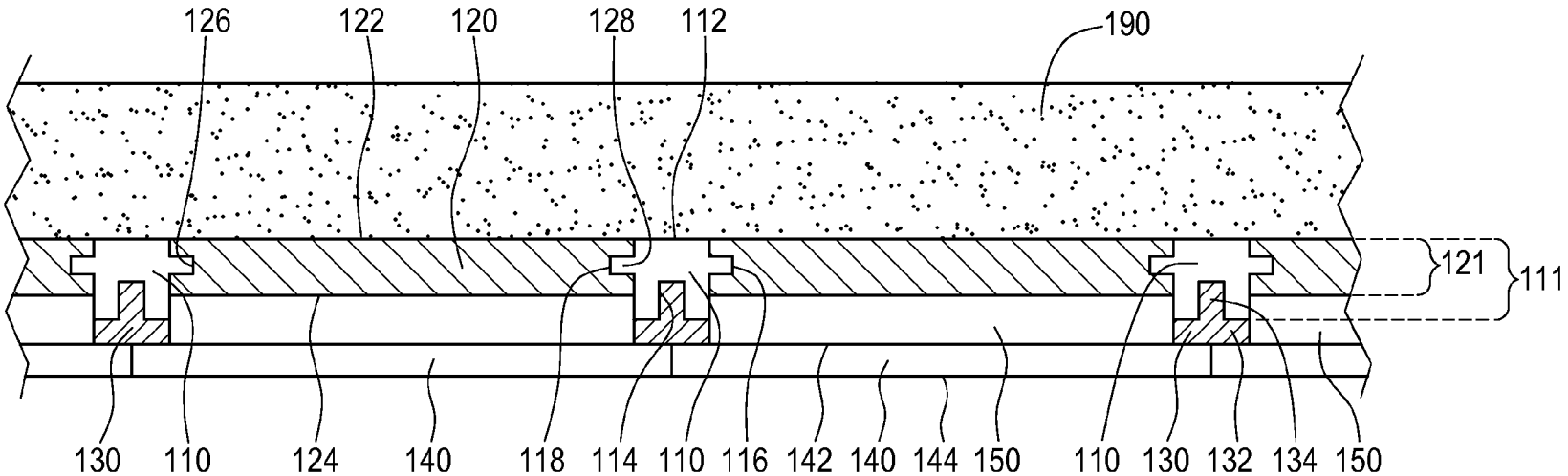
FIG. 1 illustrates an elevation view of a horizontal cross-section of a sliding and locking energy-efficient wall assembly 100 taken from a plane perpendicular to the major surfaces of a vertically-erect foundation wall 190 according to an embodiment of the invention.
Figure 2:
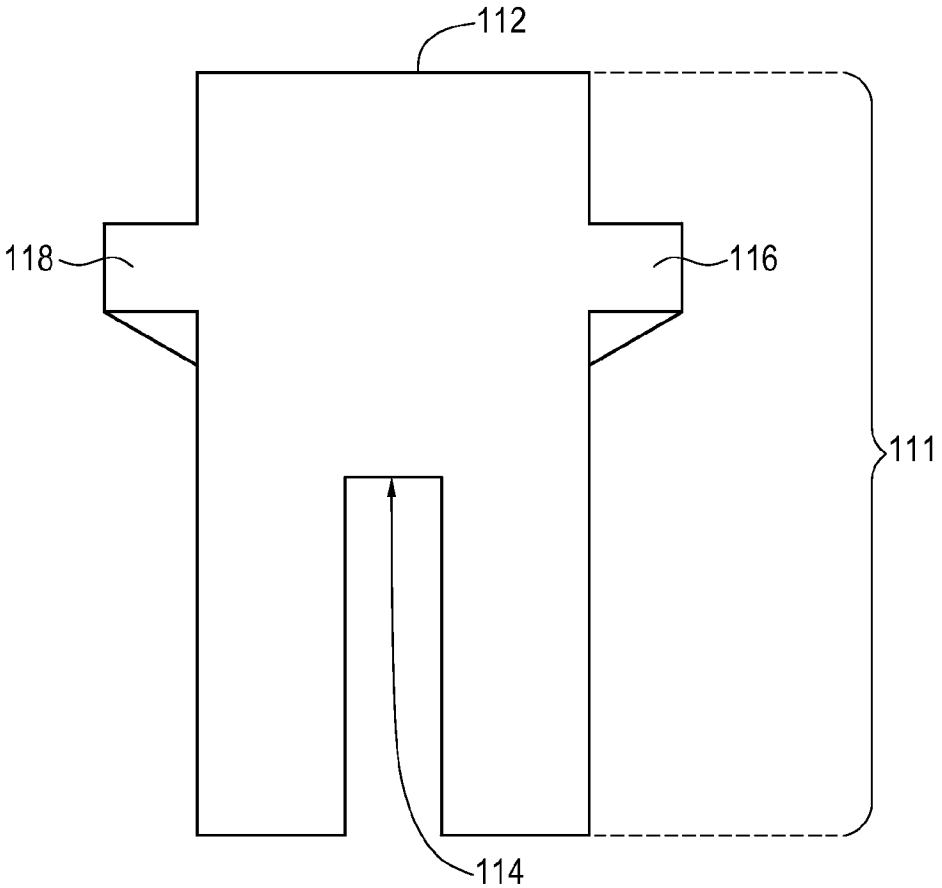
FIG. 2 illustrates an enlarged horizontal cross-sectional view of one of the foam posts 110 of the wall assembly 100 according to the embodiment shown in FIG. 1.
Figure 3:
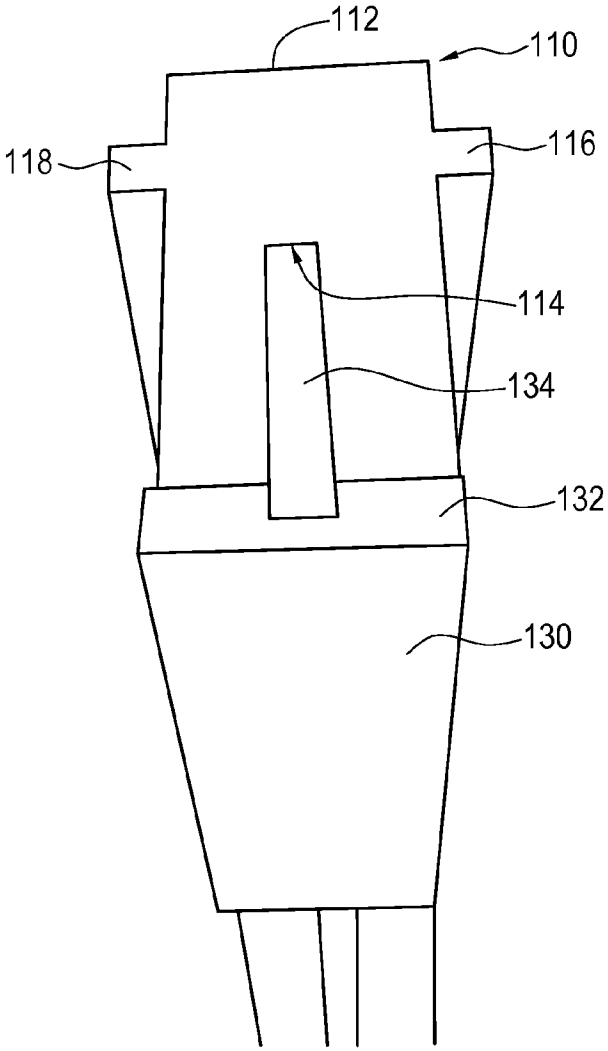
FIG. 3 illustrates a top perspective view of one of the foam posts 110 of the wall assembly 110 disposed in a mating relationship with the corresponding one of the framing/spacing members 130 of the wall assembly 100 according to the embodiment shown in FIG. 1.
Figure 4:
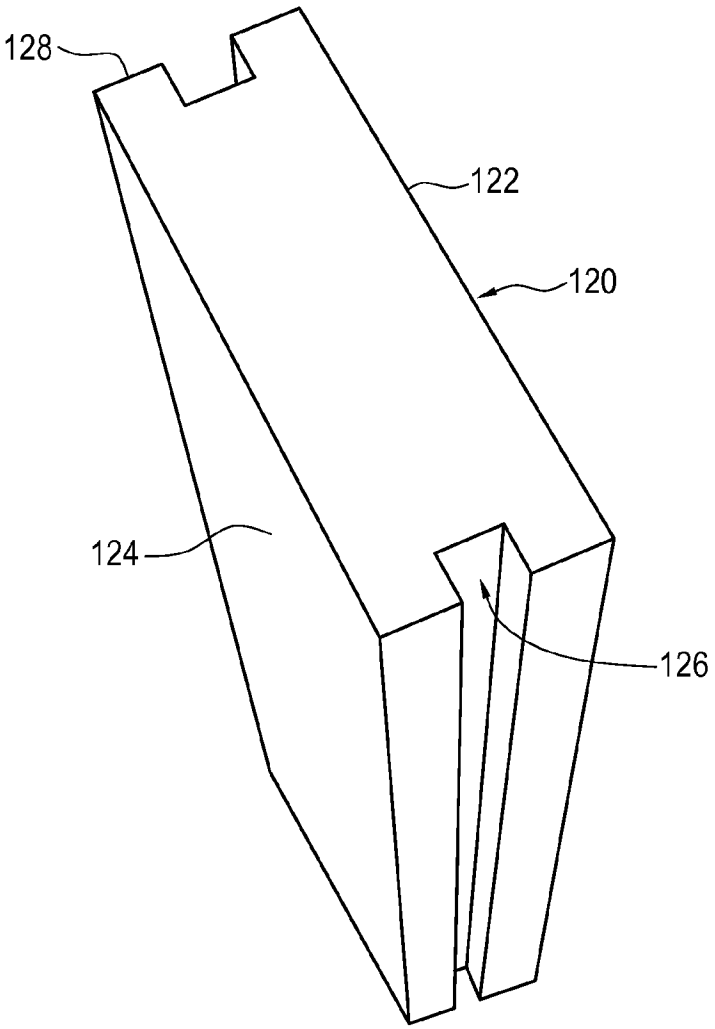
FIG. 4 illustrates a top perspective view of one of the foam panels 120 of the wall assembly 100 according to the embodiment shown in FIG. 1.

FIG. 1 illustrates an elevation view of a horizontal cross-section of a sliding and locking energy-efficient wall assembly 100 taken from a plane perpendicular to the major surfaces of a vertically-erect foundation wall 190 according to an embodiment of the invention. The sliding and locking energy-efficient wall assembly 100, hereinafter referred to as a "wall assembly 100" for brevity, includes a plurality of parallel spaced-apart foam posts 110 vertically disposed running the length or height of the foundation wall 190 and secured thereto (e.g. a concrete perimeter foundation wall). As shown in FIG. 1, the foam posts 110 each have a horizontal cross section of a predetermined shape optimally defined by four major ends, surfaces or protrusions, including an outside planar end 112 dimensioned to contact and adhere to the (inner) surface of the foundation wall 190 that faces the interior of a building, an inside grooved end opposite the planar end 112 and having a groove 114 defined therein for receiving a framing/spacing member 130, and two opposing side flanged ends 116 and 118.

The wall assembly 100 further includes a plurality of foam panels 120 each having a (first) non-coated major surface 122, a (second), optimally, coated major surface 124 having a reflective layer coated thereon for enhancing the resistance to heat transfer such as through radiation, and two grooved lateral ends having defined therein respective grooves 126 and 128. The grooves 126 and 128 defined within the grooved lateral ends of the foam panels 120 are vertically oriented and dimensioned to receive the opposing side flanged ends 116 and 118 of the foam posts in a mating relationship such that each of the respective foam panels 120 is fixedly disposed between two respective sequential foam posts 110. That is, each of the foam panels 120 is disposed between two neighbouring foam posts 110.

Preferably, each of the foam panels 120 has a thickness 121 that is less than the transverse depth 111 of the foam posts 110 such that when the non-coated major surfaces 122 of the foam panels 120 and the outside horizontal planer ends 112 of the foam posts 110 are adhered or secured to the inner surface of the foundation wall 190, the inside horizontal grooved ends 114 of the foam posts 110 extend past the edges of the reflective-layer-coated major surfaces 124 of the foam panels 120, so that an enclosed air space, air gap, or void 150 may be created in the wall assembly 100, as will be discussed in more detail below.

The wall assembly 100 further includes a plurality of framing/spacing members 130 each corresponding to different one of the foam posts 110. Each of the framing/spacing members 130 has a web portion 132 and a flange portion 134. In a preferred embodiment, the framing/spacing members 130 each have a cross sectional geometric shape of a "T", and the web portions 132 and flange portions 134 correspond to the horizontal and vertical components of the geometric "T" respectively. The flange portions 134 of the framing/spacing members 130 are dimensioned to engage the grooves 114 of the foam posts 110 in a mating relationship such that the web portions 132 of the framing/spacing members 130 provide an interior attachment surface for finishing wall panels 140.

In one embodiment, the framing/spacing members 130 may be made of a material sufficiently rigid to support the weight of the finishing wall panels 140, and may include any known load-bearing construction materials. In a preferred embodiment, the framing/spacing members 130 may be particle boards which are easily procurable, light weight, and have relatively low costs.

The wall assembly 100 further includes a plurality of finishing wall panels 140, such as dry wall panels, for example. Other materials of construction of the finishing wall panels 140 may be selected depending on the climatic conditions of the location at which the wall assembly 100 is to be deployed and installed. The finishing wall panels 140 each has an exterior surface 142 configured to be in contact with and secured to the web portions 132 of the framing/spacing members 130 in a manner such that the interior surfaces 144 of the finishing wall panels 140 collectively form an uninterrupted planar wall surface, whereby an enclosed air space, air gap, or void is created between the reflective-layer-coated major surfaces 124 of the foam panels 120 and the exterior surfaces 142 of the finishing wall panels 140.

The mating relationships between the framing/spacing members 130 and the foam posts 110 are adjustable to permit plumb installation of the finishing wall panels without the need for conventional furring shims. That is, the depth and angle of engagement of the flange portions 134 of the framing/spacing members 130 with the grooves 114 of the foam posts 110 may be adjusted until the desired (e.g. plumb) orientation of the planar wall surface collectively formed by the finishing wall panels 140 is achieved, then the panels 120 may be secured in place.

In one embodiment, the air gap 150 may preferably be approximately 2" wide to accommodate the installation of electrical boxes. In "above wall" areas where electrical boxes are typically not located however, an air gap of approximately ¾" wide may be sufficient to provide for the desired insulating capacity.

The materials for constructing the foam panels may preferably be selected from Expanded Poly-Styrene ("EPS") foam sheets with a desirably sufficient insulation and R-value. In one embodiment, the foam panels 120 are approximately 22" in width.

Figure 5:
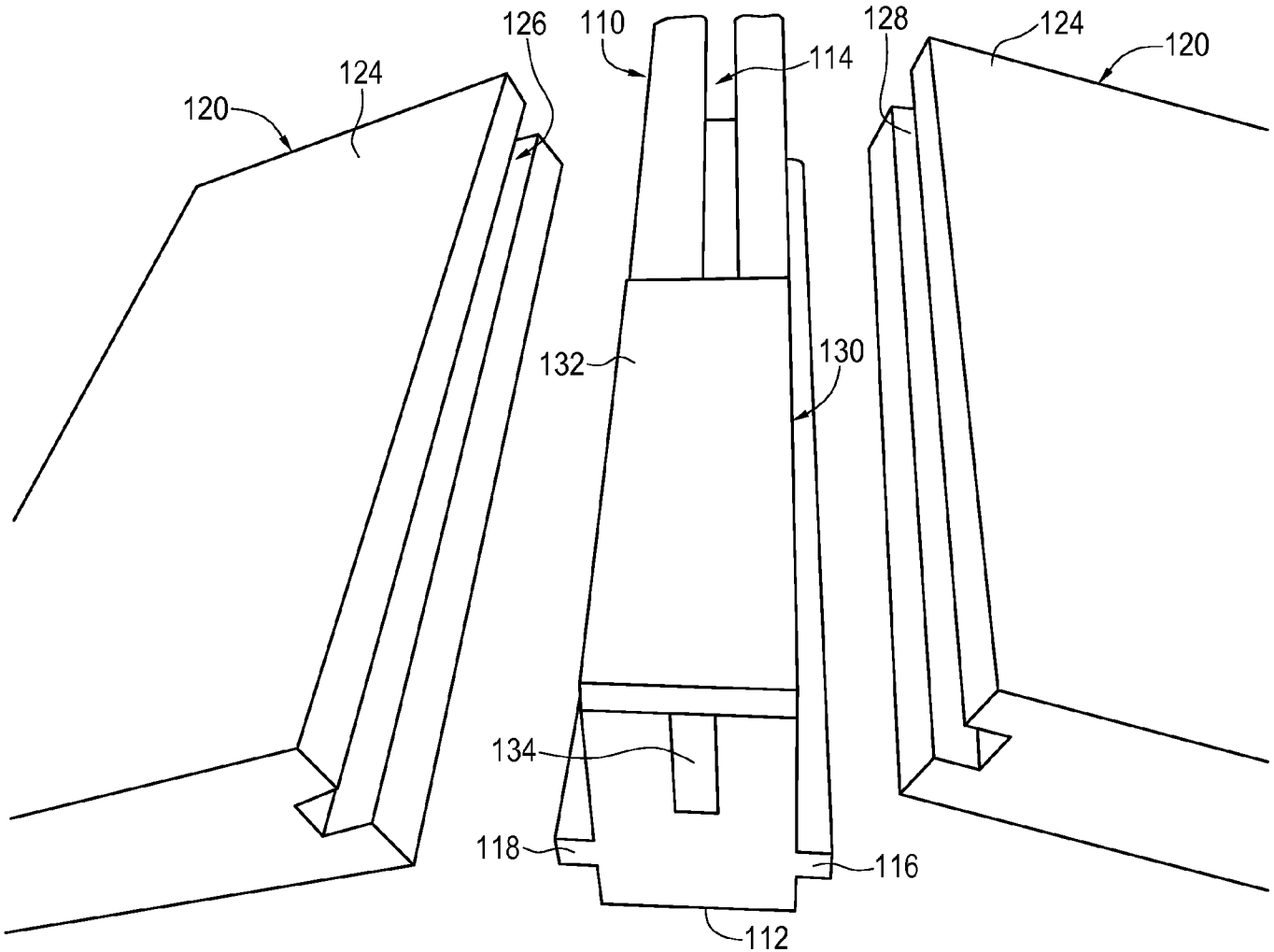
FIG. 5 illustrates a front perspective view of the wall assembly 100 showing two foam panels 120 ready to engage a foam post 110 according to the embodiment shown in FIG. 1.
Figure 6:
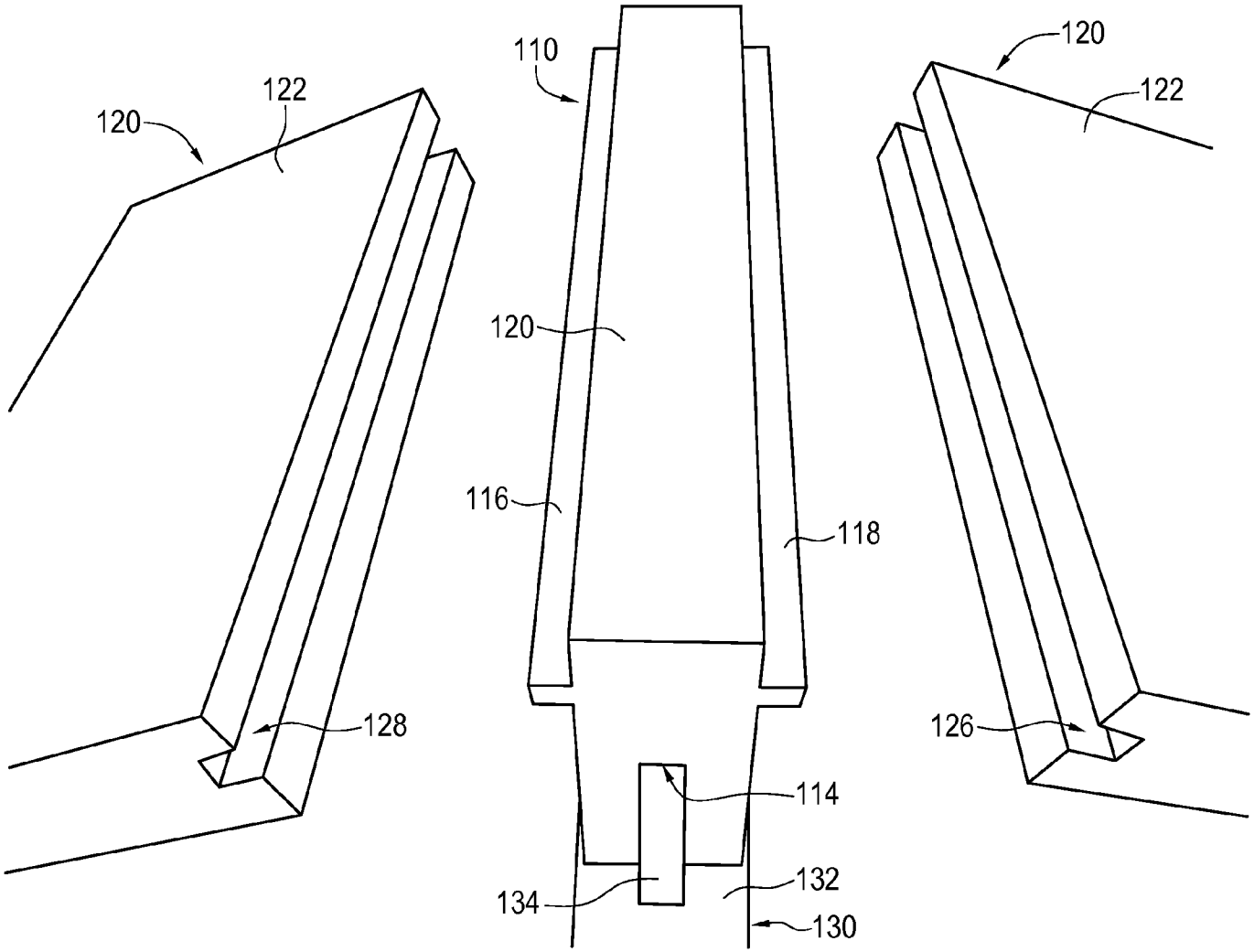
FIG. 6 illustrates a rear perspective view of the wall assembly 100 showing the first major surface 122 of the foam panel 120 configured to contact with the foundation wall 190 additionally includes a reflective layer according another embodiment of the invention.
Figure 7:
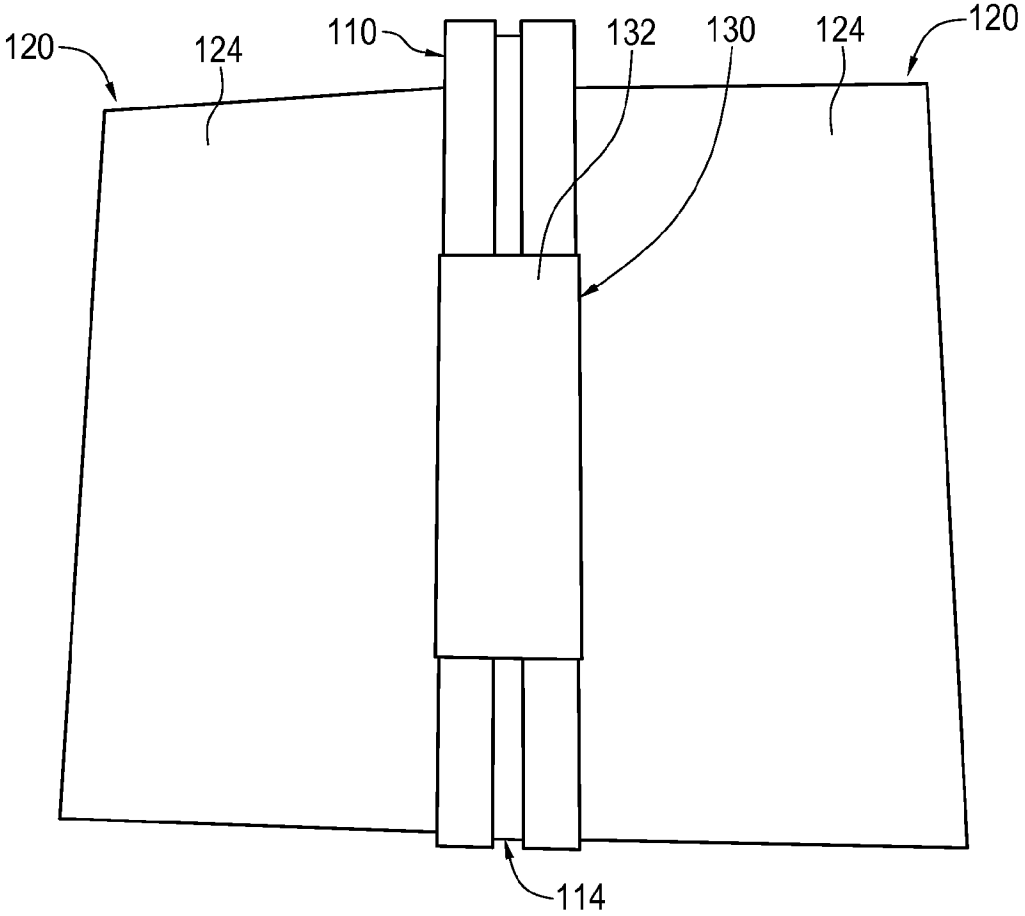
FIG. 7 illustrates an assembled rear perspective view of the wall assembly shown in FIG. 6, according to an embodiment of the invention.

In optional embodiments, the first major surfaces 122 of the foam panels 120 in contact with the foundation wall 190 may each optionally include a reflective layer such as a foil layer, similar to the reflective layer coated on the second major surfaces 124 of the foam panels 120, to act as a vapour barrier to resist the diffusion of moisture through the foundation wall 190, and to reduce radiative heat transfer from outside the structure during summer, for example. One such exemplary optional embodiment is illustrated in FIG. 5.

The invention may be employed in various applications to provide insulation capacity in various types of buildings, including concrete, steel, post frame, animal confinement, and quonset and tarp buildings, for example. Although the invention has been described through embodiments adapted for building insulation, and more particularly building wall insulation, the invention may be similarly adapted to insulate other structural elements such as concrete floors and pipes, as will be appreciated by a person of ordinary skill in the art.

Certain embodiments of the invention may have the following additional advantages. As compared to conventional fiberglass wall assemblies constructed of 2×4 framing studs and fiberglass insulation, the wall assembly 100 according to embodiments of the invention may desirably achieve an increase in effective R-value by over 100%, and may desirably reduce the labor and installation time as compared to traditional fiberglass wall assemblies by up to two thirds. Further, the feature of an added enclosed air space 150 within the wall assembly 100 according to embodiments of the invention may advantageously provide for the resistance of heat transfer through building walls via convection, which is a source of heat loss unaccounted for in traditional building fiberglass insulation techniques, which typically relies on 2×4 studs to create wall framing, followed by the installation of rigid insulation material such as fiber glass between the studs, and completed by securing drywall panels to the studs to create a wall surface without leaving an air gap. Further, as compared to the above-noted traditional wall insulation techniques that provide no air gap between the fiber glass insulation and the finishing dry wall, the feature provided by embodiments of the invention in the combination of a reflective coating on one or both of the major surfaces of the foam panels 120 and the air gap 150 provides for a more effective radiant barrier to inhibit heat transfer from thermal radiation originating from the inside of the buildings.

It is to be noted that although the foam posts 110 in the above-described embodiments of the invention have been described as being vertically installed running length-wise or along the height of the vertically-erected foundation walls 190, it will be appreciated by a person of ordinary skill in the art that the orientation of the foam posts 100, and the orientations of the accompanied foam panels 120, framing/spacing members 130, and finishing wall panels 140 should not be so limited to those as described provided that the advantages of the invention may be realized in the alternative orientations. Factors that determine the precise orientations of these components of the wall assembly 100 may depend on the requirements of the building to which the wall assembly 100 is to be applied and the climatic conditions of the surrounding areas where the building is to be constructed.

It practice, the foam posts 110 are first adhered to a foundation wall 190. Framing/spacing members 130 are then installed plumb, leaving the flange portions 134 often at an oblique angle in relation to the grooves 114 in the foam posts 110, due to the uneven nature of most constructed walls 190. The spacing/framing members 130 are then secured in place, and finishing panels 120 are attached to the outer surface of the web portions 132 of the framing/spacing members 130. As can be readily appreciated by a person of ordinary skill in the art, the installation herein described is fast and efficient. The components described above can be provided in modular, kit format in an embodiment, including instructions of desired, to form a modular wall system which has a high thermal insulation value with respect to convection and radiation.

An embodiment of the present invention also relates to a hermetic thermally insulating and radiant reflective building material which may be used in connection with at least one major surface of the components of the above-described sliding and locking wall assembly such as to desirably effectively reduce energy migration from buildings.

In one such embodiment, such hermetic building materials may desirably have high insulation and radiant reflecting values and may typically comprise extruded polystyrene composite foam (EPS) or other composites, for example. In one embodiment, a thin hermetic radiant reflective laminate material may also be applied to one or both sides of the building material.

In some conventional building section arrangement, the radiant reflective building material may undesirably have its radiant reflective effectiveness value greatly reduced when another material is installed closely against the reflective side of the building material. According to an embodiment of the present invention, when air spaces are arranged between the radiant reflective material the radiant reflective value effectiveness increases and thus radiant heat may desirably be reflected back to the occupied volume. A suitable such air space between the building materials may usefully be accomplished by application of the above-described sliding and locking energy efficient wall assembly according to an embodiment of the invention, such as to create a desirable air gap to develop high reflective efficiencies.

In a further embodiment of the present invention, a building material for use for enclosures, roofs and foundations that form a building envelope, may comprise a central core element such as an exemplary wood/steel frame or concrete or other structural arrangement. The interior and exterior final wall surface material of such an embodiment may respectively comprise any surfaces fabricated to operate properly for the climatic conditions of the building location.

In one such embodiment, the installation, attachment and interface of the hermetic insulated radiant reflective building material are aligned with a plurality of contact points touching the interior and exterior final wall surface materials. The contact points touching the interior and/or exterior can be aligned in any suitable orientation, such as horizontally vertically or in a pyramidal arrangement, for example.

The thermally insulated radiate reflective material may desirably have a hermetic radiant reflective laminate coating on one or both sides. The surfaces including the surfaces that are fabricated to create air spaces adjacent to the contact points may desirably have this laminate attached. In one such embodiment, such air spaces allow desirably higher radiant reflective effectiveness values to be realized due in at least part to the reflective material not touching the interior and exterior final wall surface material. In such an embodiment, the radiant reflective laminate may desirably radiate heat back into interior thus increasing interior air temperature and thus reducing the amount of energy to maintain temperature and comfort levels of the occupants. Or on the exterior the solar radiation may be desirably reflected to reduce unwanted heat gain. Such trapped air spaces constructed according to such an embodiment may also add to the thermal insulation of the building material.

In another embodiment, the hermetic radiant reflective layer on the building material may also desirably reduce latent heat loss via reduction of water vapour transmission due to any vapour pressure differences between the interior and exterior air masses. Such building materials according to embodiments of the present invention can be installed and orientated depending on the requirements of the building and the climatic conditions of the areas where the building will be constructed.

The exemplary embodiments herein described are not intended to be exhaustive or to limit the scope of the invention to the precise forms disclosed. They are chosen and described to explain the principles of the invention and its application and practical use to allow others skilled in the art to comprehend its teachings.

As will be apparent to those skilled in the art in light of the foregoing disclosure, many alterations and modifications are possible in the practice of this invention without departing from the scope thereof. Accordingly, the scope of the invention is to be construed in accordance with the substance defined by the following claims.

What is claimed is:

1. A sliding and locking energy-efficient wall assembly, comprising:

a plurality of parallel spaced apart foam posts vertically disposed on a foundation wall, said foam posts each having a horizontal cross section of a predetermined shape defined by at least four major ends including an outside planar end dimensioned to contact and adhere to the surface of the foundation wall, an inside grooved end opposite the planar end, and two opposing side flanged ends;

a plurality of foam panels, each having a first major surface, a second major surface opposing the first major surface, wherein at least one of said first and second major surfaces comprise a reflective-layer-coating, and two lateral ends each having a groove defined therein, said grooves defined in the lateral ends of the foam panels and being dimensioned to receive said side flanged ends of said foam posts in a mating relationship such that each of the respective foam panels is disposed between two respective sequential foam posts and such that said first major surfaces of the foam panels are in contact with said surface of said foundation wall;

a plurality of framing/spacing members each corresponding to a foam post, said framing/spacing members each having a web portion and a flange portion, said flange portions being dimensioned to engage said inside grooved ends of said foam posts in a mating relationship such that the web portions provide an interior attachment surface for a plurality of finishing wall panels; and said plurality of finishing wall panels each comprising an interior surface and an exterior surface, the exterior surfaces of said finishing wall panels being in contact with and secured to the web portions of the framing/spacing members, whereby an air space is created between the reflective-layer-coating of the at least one major surface of the foam panels and the exterior surfaces of the finishing wall panels;

wherein the mating relationships between the framing/spacing members and the foam posts are adjustable to permit plumb installation of the finishing wall panels.

2. The sliding and locking energy-efficient wall assembly according to claim 1, wherein each of the foam panels has a thickness less than the transverse depth of the foam posts such that when a major surface of the foam panels and the outside horizontal planar ends of the foam posts are secured to the foundation wall, the inside grooved ends of the foam posts extend past at least one reflective-layer-coated major surface of the foam panels.

* * * * *